US008052547B2

(12) United States Patent
Nusbaum et al.

(10) Patent No.: US 8,052,547 B2
(45) Date of Patent: Nov. 8, 2011

(54) SPORT ITEM HANDLE END CAP

(75) Inventors: Christopher R. Nusbaum, Holland, OH (US); John M. Joseph, Swanton, OH (US); Chris M. Block, Toledo, OH (US); Garett M. Gillen, Tecumseh, MI (US)

(73) Assignee: NIKE, Inc., Beaverton, OR (US)

( * ) Notice: Subject to any disclaimer, the term of this patent is extended or adjusted under 35 U.S.C. 154(b) by 864 days.

(21) Appl. No.: 11/103,884

(22) Filed: Apr. 12, 2005

(65) Prior Publication Data

US 2006/0229147 A1 Oct. 12, 2006

(51) Int. Cl.
*A63B 69/00* (2006.01)
*A63B 49/08* (2006.01)
*A63B 59/00* (2006.01)

(52) U.S. Cl. ..... 473/457; 473/549; 473/568

(58) Field of Classification Search ..... 473/564–568, 473/552, 553, 538, 521, 519, 422, 298, 300, 473/523, 549

See application file for complete search history.

(56) References Cited

U.S. PATENT DOCUMENTS

| | | | | | |
|---|---|---|---|---|---|
| 178,908 | A | * | 6/1876 | Clark | 40/668 |
| 1,026,990 | A | | 5/1912 | Matson | |
| 1,644,083 | A | * | 10/1927 | Reach | 473/298 |
| 2,644,978 | A | * | 7/1953 | Becker | 16/42 R |
| 2,670,871 | A | * | 3/1954 | Spiess, Jr. et al. | 220/789 |
| 3,168,961 | A | * | 2/1965 | Yates | 220/787 |
| 3,233,502 | A | * | 2/1966 | Fernberg | 411/500 |
| 3,703,290 | A | * | 11/1972 | Wilson | 473/520 |
| 3,779,551 | A | * | 12/1973 | Wilson | 473/568 |
| 3,811,596 | A | * | 5/1974 | Wilson | 220/315 |
| 3,830,496 | A | * | 8/1974 | Reizer | 473/567 |
| 4,131,981 | A | | 1/1979 | Scott et al. | |
| 4,195,837 | A | * | 4/1980 | Poulin | 473/298 |
| 4,505,479 | A | | 3/1985 | Souders | |
| 4,634,121 | A | | 1/1987 | Sasaki | |
| 4,936,586 | A | | 6/1990 | Van Raemdonck | |
| 5,145,171 | A | * | 9/1992 | Head et al. | 473/300 |
| 5,380,003 | A | | 1/1995 | Lanctot | |
| 5,417,503 | A | * | 5/1995 | Brennan, III | 401/92 |
| 5,421,572 | A | * | 6/1995 | MacKay, Jr. | 473/566 |
| 5,499,737 | A | * | 3/1996 | Kraus | 220/787 |
| 5,605,327 | A | * | 2/1997 | McCutchen | 473/523 |
| 5,674,138 | A | | 10/1997 | Nolan | |
| 5,730,662 | A | * | 3/1998 | Rens | 473/300 |
| 5,749,574 | A | * | 5/1998 | Curtis | 473/531 |
| 5,865,694 | A | * | 2/1999 | Duong-Van | 473/520 |
| 6,045,467 | A | | 4/2000 | Anderson | |
| 6,089,996 | A | | 7/2000 | Hsu | |
| 6,106,417 | A | * | 8/2000 | Umlauft et al. | 473/537 |
| 6,159,115 | A | | 12/2000 | Hsu | |
| 6,334,825 | B1 | | 1/2002 | Buiatti | |
| 6,443,860 | B1 | | 9/2002 | Byrne et al. | |
| 6,609,984 | B1 | | 8/2003 | Tribble | |
| 6,612,945 | B1 | | 9/2003 | Anderson | |
| 7,232,387 | B1 | * | 6/2007 | Heald et al. | 473/566 |
| 2006/0201957 | A1 | * | 9/2006 | Harrington et al. | 220/787 |

* cited by examiner

*Primary Examiner* — Mitra Aryanpour
(74) *Attorney, Agent, or Firm* — Plumsea Law Group, LLC

(57) ABSTRACT

The present invention relates to a hollow knob for a sport item, for example, a bat, a golf club, or a racket, which has four flexible fingers. Each finger has an inclined peg formed on an exterior surface of each finger, such that when the knob is slid into an end of a sport item handle, each inclined peg becomes captive of a corresponding hole in the handle. When an insert is slid into a hollow area of the knob, where a ramp is formed near the top end of the interior of each finger, the knob becomes secured to the handle. An adhesive may then be applied to this assembly in order to prevent tampering of the handle by requiring destruction of the assembly.

16 Claims, 5 Drawing Sheets

SPORT ITEM HANDLE END CAP

FIELD OF THE INVENTION

The present invention relates to an end cap for a sport item handle. More particularly, the present invention relates to a tamper proof end cap or knob for a sport item handle.

BACKGROUND OF THE INVENTION

A sport item, like a softball bat, a baseball bat, a golf club, or a racket of any type, has a handle that is gripped by a sport participant. Manufacturers of such sport items are encouraged to design the sport item in such a way as to discourage tampering with the sport item. Often, the manufacturer installs an end cap or knob on the open end of the sport item handle to close the open end and to discourage an individual from disposing material and/or removing material within/from the sport item. Manufacturers may also use the end cap to add weight to the sport item.

Examples of relevant art involving sport items are as follows. U.S. Pat. No. 4,131,981 to Scott et al. teaches a method for securing a knob to a ball bat handle. As best seen in FIG. 4, the handle has at least two apertures. The apertures receive a pin. The pin extends through a first hole in the knob, through both apertures in the handle and then through a second hole in the knob to attach the knob to the handle.

U.S. Pat. No. 4,936,586 to Van Raemdonck provides for a racket handle having an end-piece that is slid onto an inner core. The end-piece is taught to be constructed of rubber, synthetic rubber or an elastomer. Central to the end-piece, an axial recess is provided. The recess comprises a central cylindrical portion. The end piece is designed to receive an interchangeable, cylindrical balasting element. The balasting element is provided with two studs. The studs slide within slots in the end piece. The balasting element can then be rotated, to selectively misalign the studs with the slots to prevent removal of the balasting element.

U.S. Pat. No. 6,045,467 to Anderson teaches a knob for metal bats having two locking features to keep it in place. The first locking feature is a high strength adhesive that is located at the interface of the knob and the knob receiving end of the bat handle. The second locking feature is a metal snap ring seated within a groove around the knob receiving end of the bat handle. If the first locking feature fails, the ring will move from the groove to a tapered ring retention chamfer in the knob. The chamfer lies immediately adjacent the groove. In this second position, the ring becomes compressed and forms a clamp around the knob receiving end of the bat handle.

U.S. Pat. No. 6,089,996 to Hsu depicts and describes a racket handle having an end cap. A flexible frame is inserted into an aperture of the end cap. The frame is a cup-like member made of a flexible material, such as rubber or PVC. The bottom of the frame is closed, however, the top of the frame is open. A positioning flange extends radially inward from the inside of the flexible frame. The open end of the flexible frame has an annular flange extending radially outward. The radially outward extending flange engages with a bottom board. A weight is retained between the positioning flange and the bottom of the frame. According to the patent, the weight allows the flexible frame to be "swingable" in the racket handle.

U.S. Pat. No. 6,334,825 to Buiatti is a patent dealing with an end cap assembly for the barrel of the bat. Specifically, the patent teaches a sleeve that contacts the bat wall and is secured thereto. The end cap is inserted into the sleeve. A groove in the end cap accepts a rim formed with the sleeve.

U.S. Pat. No. 6,443,860 to Byrne et al. teaches a knob for a metal bat. The knob essentially has two components: a metal collar welded to the handle portion and a plug that fits within the collar. In the embodiment depicted in FIGS. 3-6, the collar has a hole H and an opening O. The opening has a circumferential edge. The plug has an edge with a complementary shape to the edge of the opening. The plug also has a stem portion that fits within the hole of the collar. The plug and the collar fit together, as shown in FIG. 6. FIG. 7 depicts one embodiment of how the plug and collar can be engaged with one another. A plurality of tabs on the plug can be located under the rim of the collar. For example, by rotating the plug, and thus the tabs, the tabs are located under the rim of the collar. The patent states that by pressing inwardly on the plug, the plug can be released from the collar.

U.S. Pat. No. 6,612,945 to Anderson teaches an end cap for a ball bat barrel, where a hole is located in a portion of the bat, barrel or handle. The holes in the barrel receive pins that are inserted from the outside of the barrel to the inside. The pins secure an outer wall (the barrel) with an inner wall of the barrel and the end plug.

Unfortunately, tampering with sport item end caps or knobs that have been pinned, threaded, snap ringed, plugged, etc. is still prevalent. Thus, a better tamper proofing means for the sport item end cap or knob is still being sought.

SUMMARY OF THE INVENTION

The present invention relates to a sport item end cap that comprises at least one flexible finger formed on an end thereof, where the finger has an exterior surface with an inclined peg disposed thereon.

Further advantages of the present invention will be apparent from the following description and appended claims, reference being made to the accompanying drawings forming a part of a specification, wherein like reference characters designate corresponding parts of several views.

DETAILED DESCRIPTION OF THE PREFERRED EMBODIMENTS

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise.

Figure 1:
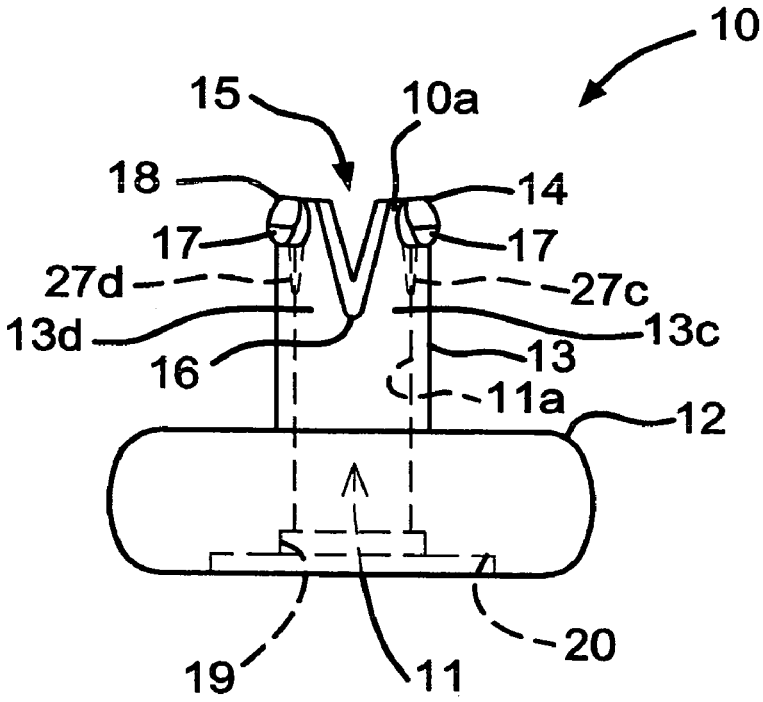
FIG. 1 is an elevation view of a sport item handle knob in accordance with the present invention.
Figure 2:
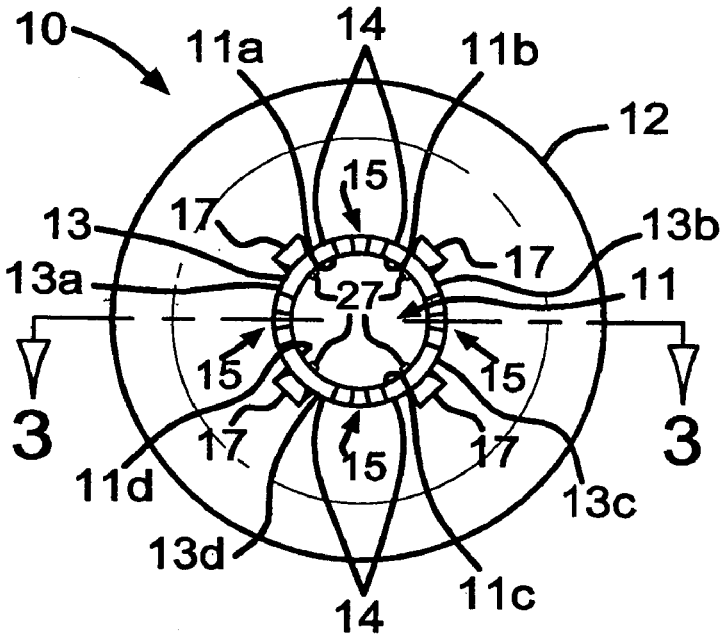
FIG. 2 is top view of the sport item handle knob of FIG. 1.

FIGS. 1 and 2 (top view of FIG. 1) illustrate a particularly preferred embodiment of a hollow sport item end cap or knob 10 of the present invention, having a void 11 axially defined therethrough, a lower base portion 12, which may be wider than an upper portion 13. Four somewhat flexible fingers 14 with V-shaped grooves 15 defined therebetween, are shown where the V-shaped grooves 15 are formed to an approximate axial mid-point 16 of the upper knob portion 13. The fingers 14 being formed on an end portion 10*a* of the sport item knob 10. An inclined peg 17 disposed on the exterior surface 13*a-d* of each of the flexible fingers 14 is depicted in FIGS. 1 and 2. The end cap 10 also comprises a top edge 18, an annular groove 19 defined at a base of the lower portion 12 near the insert cap void 11 and a recess 20. Further, the end cap 10 comprises a ramp 27 (see FIG. 2) disposed within the sport item knob void 11, on an interior surface 11*a-d* of each of the fingers 14.

Although the embodiment depicted in the figures includes the four flexible fingers 14 with the corresponding V-shaped grooves 15 (which may be embodied in other shapes, for example, U-shaped), four inclined pegs 17, and four ramps 27, the present invention could be embodied with any number of these items 14, 15,17, and 27.

It is preferable that the hollow sport item knob 10 and an insert 21 (see FIG. 4 that illustrates an insert 21 having an insert cap 22 and a rim 23) are constructed of plastic, however, it is possible to construct these items 10, 21 of metal, rubber, or other suitable material, and still remain within the spirit and scope of the present invention.

As stated above, the lower base portion is wider than the upper portion of the hollow sport item knob 10, however, it is also within the spirit and scope of the present invention that the two portions 12, 13 are of the same width or close to the same width.

Figure 3A:
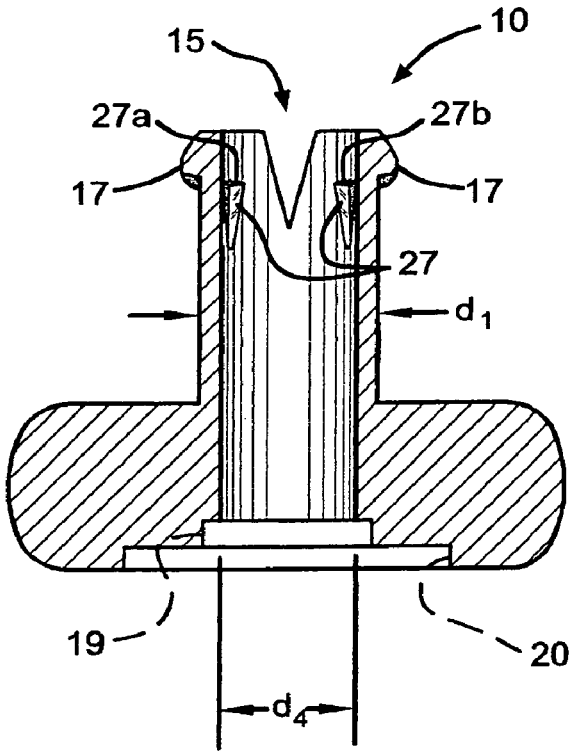
FIG. 3*a* is a cutaway view of the sport item handle knob, taken along the 3-3 line of FIG. 2.
Figure 4:
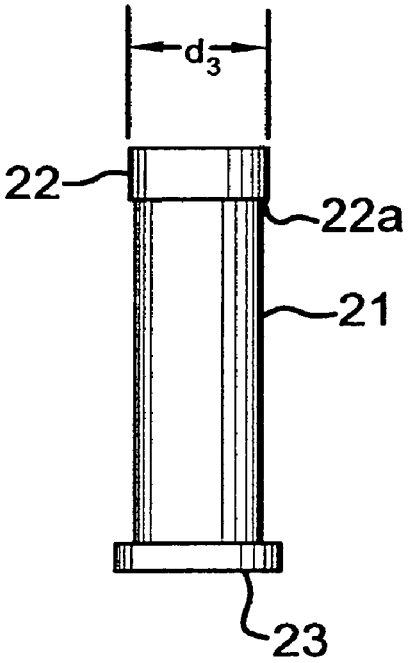
FIG. 4 is an elevation view of an insert in accordance with the present invention.

FIG. 4 illustrates the insert 21 having the dimension $d_3$ that is approximately the same as the dimension $d_4$ of the knob 10 (see FIG. 3*a*, which is a cutaway view of the sport item knob 10 taken along the 3-3 line of FIG. 2). The insert 21 is capable of being forcibly slid within the hollow sport item knob 10 to a point where an insert cap bottom 22*a* has gone past ramp tops 27*a-d* and, simultaneously, the insert rim 23 would be disposed in an annular groove 19 of the knob 10. As a result, each of the ramps 27, subsequently, resists withdrawal of the insert 21 from the knob void 11, thus securing the insert 21 within the sport item knob 10. In addition, the inclined pegs 17 are further secured within corresponding handle holes 26 (see FIG. 5), by way of the insert cap 22. Thus, the sport item knob 10 is tamper proof, since tampering with the inclined pegs 17 would result in the destruction of the sport item knob 10.

Figure 5:
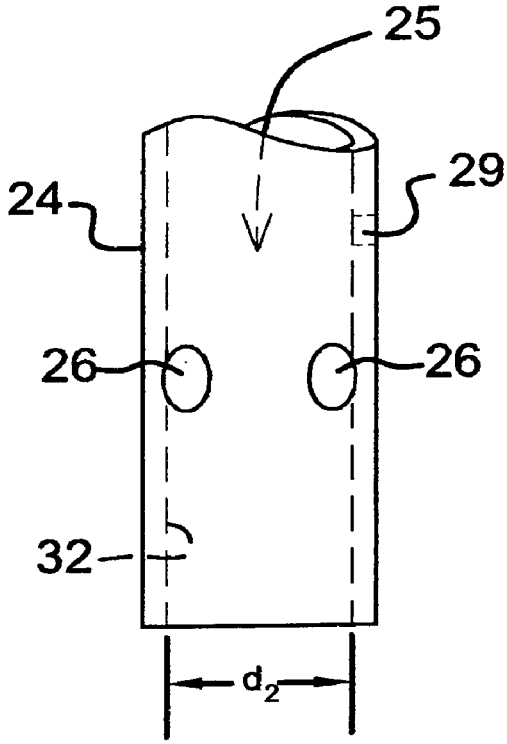
FIG. 5 is an elevation view of an end of a sport item handle in accordance with the present invention.
Figure 7:
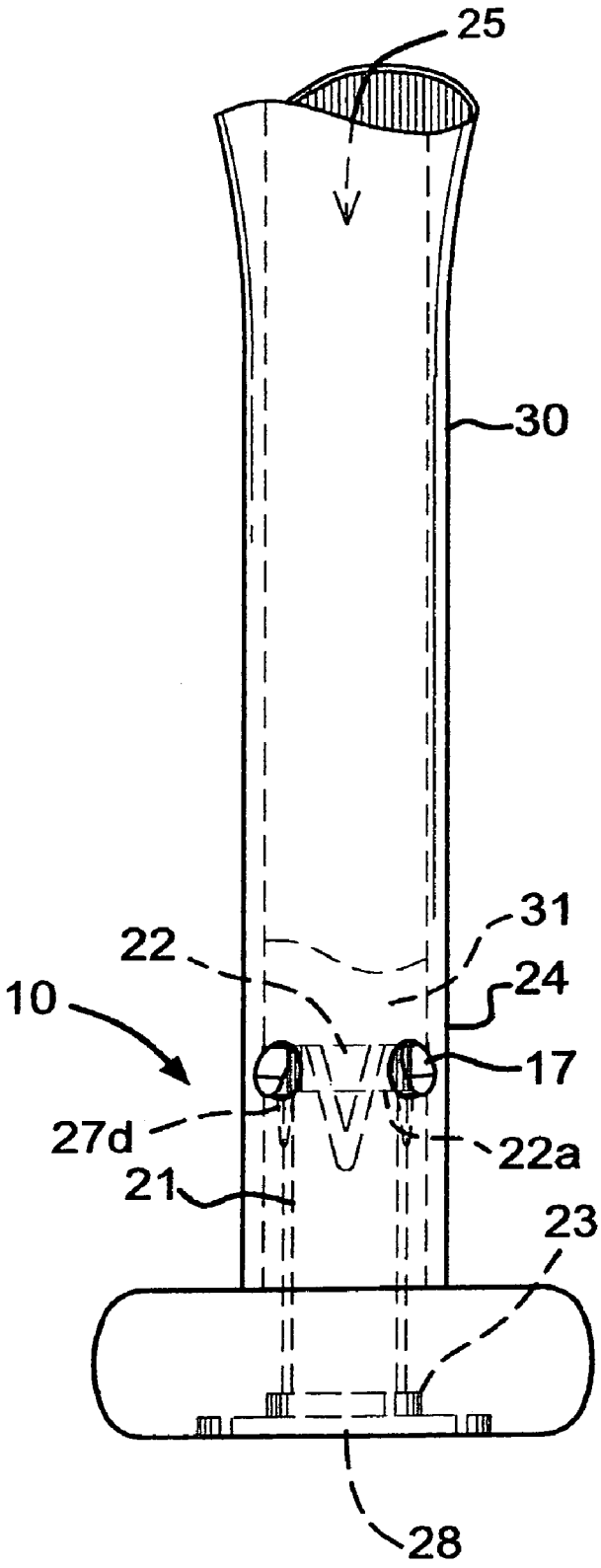
FIG. 7 is a three dimensional view of a ball bat assembly in accordance with the present invention.

FIG. 5 depicts a portion of the lower end of a sport item handle 24 having a handle void 25 axially defined therethrough, and two of four handle holes 26 laterally defined therethrough. As an added tampering deterrent, after assembling the sport item knob 10 to the lower portion of the handle 24 and assembling the insert 21 within the sport item knob 10, an adhesive 31, as shown in FIG. 7, may optionally be forcibly disposed (or applied) down and through the handle void 25.

The application of the adhesive 31 could be provided through the handle void 25, if the handle void 25 was axially defined therethrough, or through a filler hole 29 (see FIG. 5) that is laterally defined through the bat handle 24 at a point which is above the knob top edge 18. The adhesive 31, for example, a urethane, would further assure the destruction of the sport item knob 10 to the handle 24, if tampering is attempted, by being disposed into at least the assembly of the items 10, 24, 21.

Figure 3B:
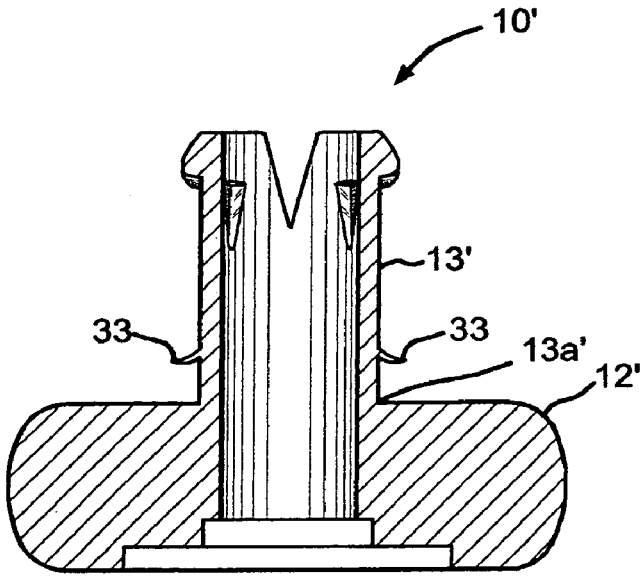
FIG. 3*b* is a cutaway view of the sport item handle knob, taken along the 3-3 line of FIG. 2 and having a wiper.

As illustrated in FIG. 3*b*, a wiper ring 33 may optionally be disposed around an upper portion 13' of a knob 10'. When the adhesive 31 flows down and throughout the assembly of the knob 10' to the lower portion of the bat handle 24 (see FIG. 5), the adhesive 31 may flow out from the knob 10' and between the bottom of the bat handle 24 and the knob 10', at a juncture point 13*a'* where the upper knob portion 13' and the lower knob portion 12' come together on the knob 10' exterior.

Figure 8:
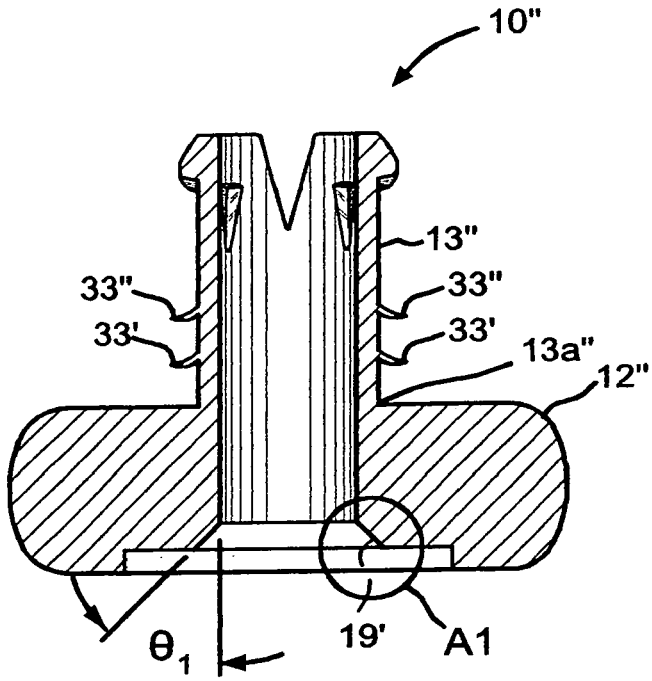
FIG. 8 is an alternate embodiment of the sport item handle knob of FIG. 3*b;*

Thus, the wiper ring 33, which may be somewhat flexible, would prevent passage of the adhesive 31 from getting out of the knob 10/bat handle 24 assembly, by blocking the path of the adhesive 31. It is within the spirit and scope of the present invention that there may be two or more wiper rings 33', 33", as illustrated in FIG. 8 for a knob 10". These wiper rings 33', 33" would decrease the chance for the adhesive 31 to get past the juncture point 13*a"*.

Although illustrated in FIG. 4 as a solid part, it is conceivable that the insert 21 may have at least a partially disposed axial void (not shown) defined within. Also, even though the sport item knob 10, the insert 21, and the sport item handle 24 are depicted as having a circular cross section, it is within the spirit and scope of the present invention that the cross section of these items 10, 21, 24 could be of various complementary cross sections, for example, a square, a rectangle, and/or an oval.

The outside dimension $d_1$ (see FIG. 3*a*) of the hollow sport item knob 10 is such that it is somewhat less than the inside dimension $d_2$ (see FIG. 5) of the sport item handle 24. As a result, the sport item knob 10 is capable of being slid within the sport item handle 24 in such a manner as to have the flexible fingers 14 compress, due to the inclined pegs 17 being forced against a sport item handle interior 32 (i.e., within the void 25). This sliding motion would continue until the inclined pegs 17 become engaged with the corresponding handle holes 26 of the sport item handle 24.

It is not required that the holes 26 be equidistantly positioned from one another, that the holes 26 be positioned at the same dimension from the end of the sport item handle 24, or that the holes 26 be of the same shape and/or size. However, each of the holes 26 must be located in a position from the end of the sport item handle 24 that corresponds to a like inclined peg 17, so that each of the four inclined pegs 17 will simultaneously be captive of a corresponding handle hole 26. The shape and size of each handle hole 26 must be capable of allowing its corresponding inclined peg 17 to enter the handle hole 26, which in turn relieves the compression of each flexible finger 14.

Figure 6:
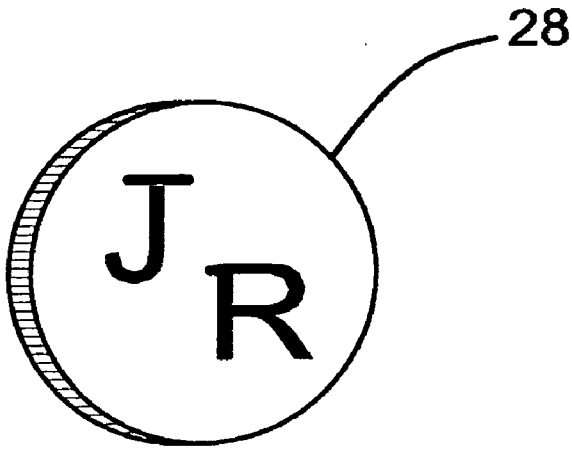
FIG. 6 is a three dimensional view of a jewel in accordance with the present invention.

After complete assembly of the knob 10 to the handle 24, it is customary in the art, but not required, to assemble a "jewel" 28 (i.e., an end cap insert, as shown in FIG. 6) to the recess 20. FIG. 7 depicts a preferred embodiment of a ball bat 30 with a complete assembly of the bat handle 24, with the insert 21 and the jewel 28, to the knob 10.

Figure 9:
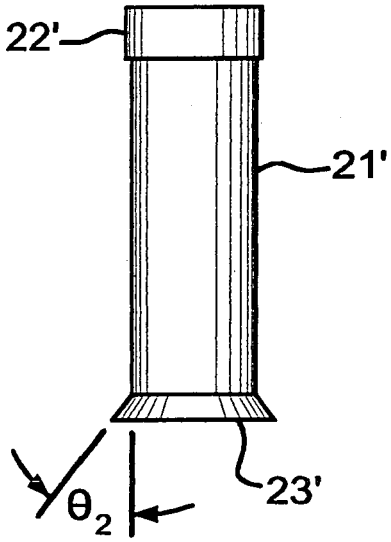
FIG. 9 is an alternate embodiment of the insert of FIG. 4.
Figure 10:
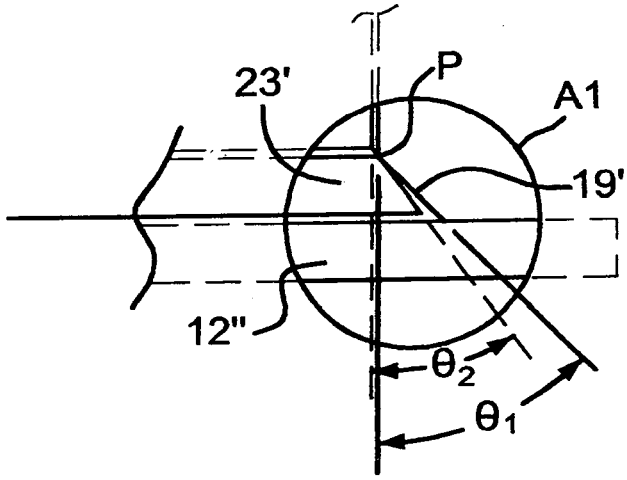
FIG. 10 is detailed cut away view of an area A1 of FIG. 8.

FIG. 8 depicts an alternate embodiment of an annular groove 19', shown in an area A1, where the annular groove 19' is formed at an angle $\Theta_1$. FIG. 9, on the other hand, depicts an alternate embodiment of an insert 21', where an insert rim 23' is formed at an angle $\Theta_2$, where $\Theta_1$ is greater than $\Theta_2$ (i.e., $\Theta_1 > \Theta_2$). A more detailed depiction of the area A1 of FIG. 8 is shown in FIG. 10, where the insert rim 23' touches the annular groove 19' at contact point P. This contact has been found to better prevent adhesive 31 from passing through the annular groove 19'.

In accordance with the provisions of the patent statutes, the principles and modes of operation of this invention have been described and illustrated in its preferred embodiments. However, it must be understood that the invention may be practiced otherwise than specifically explained and illustrated without departing from its spirit or scope.

What is claimed is:

1. A bat comprising:

a gripping portion that defines an area for gripping the bat, the gripping portion having an exterior surface and an opposite interior surface that defines an interior void aligned with a longitudinal axis of the bat, and the gripping portion having a plurality of apertures extending entirely through the gripping portion and from the interior surface to the exterior surface, the apertures extending in a direction that is substantially perpendicular to the longitudinal axis; and an end cap at least partially located within the interior void, the end cap defining a plurality of protrusions extending into the apertures.

2. The bat recited in claim 1, further comprising a ball striking portion, at least the gripping portion having a cylindrical configuration.

3. The bat recited in claim 1, wherein the end cap has a first portion and a second portion, the first portion being located within the void of the gripping portion, and the second portion being outside of the gripping portion, a diameter of the exterior surface of the gripping portion being less than a diameter of the second portion.

4. The bat recited in claim 1, wherein the end cap defines notches located between the protrusions.

5. The bat recited in claim 4, wherein the notches form independently-deflectable fingers.

6. The bat recited in claim 4, wherein the notches are V-shaped.

7. The bat recited in claim 1, wherein at least one of the protrusions has an end area with an inclined surface.

8. The bat recited in claim 1, wherein the end cap defines a cavity extending entirely through the end cap, and an insert is located within the cavity.

9. A bat comprising:

a ball striking portion;

a gripping portion extending from the ball striking portion and having a substantially cylindrical configuration, the gripping portion being aligned with a longitudinal axis of the bat and defining an interior void extending in a direction of the longitudinal axis, and the gripping portion defining a plurality of apertures that are substantially perpendicular to the longitudinal axis and extend entirely through the gripping portion and from the void to an exterior surface of the gripping portion; and an end cap at least partially located within the void in the gripping portion, the end cap defining a plurality of pegs that extend into the apertures of the gripping portion.

10. The bat recited in claim 9, wherein the end cap defines notches located between the pegs, and the notches form independently-deflectable fingers extending toward the ball striking portion.

11. The bat recited in claim 9, wherein at least one of the pegs has an end area with an inclined surface.

12. The bat recited in claim 9, wherein the end cap defines a cavity extending entirely through the end cap, and an insert is located within the cavity.

13. The bat recited in claim 9, wherein the end cap has a first portion and a second portion, the first portion being located within the void of the gripping portion, and the second portion being outside of the gripping portion, a diameter of the exterior surface of the gripping portion being less than a diameter of the second portion.

14. A bat comprising:

a ball striking portion;

a gripping portion extending from the ball striking portion and having an exterior surface and an opposite interior surface, the exterior surface having a substantially cylindrical configuration with a first diameter, and the interior surface defining an interior void, the gripping portion having a plurality of apertures extending entirely through the gripping portion and from the interior surface to the exterior surface; and an end cap with a first portion and a second portion, the first portion being located within the interior void of the gripping portion, and the first portion defining a plurality of protrusions extending into the apertures of the gripping portion, the second portion being outside of the interior void and having a second diameter, the first diameter being less than the second diameter.

15. The bat recited in claim 14, wherein the end cap defines notches located between the protrusions, and the notches form independently-deflectable fingers extending toward the ball striking portion.

16. The bat recited in claim 14, wherein at least one of the protrusions has an end area with an inclined surface.

* * * * *